United States Patent [19]

Jensen et al.

[11] Patent Number: 4,593,181

[45] Date of Patent: Jun. 3, 1986

[54] HEATING ELEMENT HAVING DEFORMED BUSS BARS

[75] Inventors: Michael L. Jensen, Mountain View; Carney P. Claunch, II, Redwood City, both of Calif.

[73] Assignee: Raychem Corporation, Menlo Park, Calif.

[21] Appl. No.: 577,107

[22] Filed: Feb. 6, 1984

[51] Int. Cl.[4] ..... H05B 3/36

[52] U.S. Cl. ..... 219/541; 219/549; 219/553

[58] Field of Search ..... 219/541, 549, 553, 528, 219/543, 548, 529; 29/622; 174/84 C, 94 R, 94 S; 338/212, 328, 254, 255

[56] References Cited

U.S. PATENT DOCUMENTS

| | | | |
|---|---|---|---|
| 2,961,522 | 11/1960 | Hammer | 219/543 X |
| 3,221,145 | 11/1965 | Hager, Jr. | 219/549 |
| 3,385,959 | 5/1968 | Ames et al. | 219/549 |
| 3,749,886 | 7/1973 | Michaelson | 219/528 |
| 3,757,086 | 9/1973 | Indoe | 219/528 |
| 3,758,703 | 9/1973 | Golden et al. | 174/84 C |
| 4,177,446 | 12/1979 | Diaz | 338/212 |
| 4,223,209 | 9/1980 | Diaz | 219/549 |
| 4,330,703 | 5/1982 | Horsma et al. | 219/553 |
| 4,367,398 | 1/1983 | Stunles et al. | 219/541 |

*Primary Examiner*—Clarence L. Albritton
*Assistant Examiner*—Teresa J. Walberg
*Attorney, Agent, or Firm*—Dennis E. Kovach; T. Gene Dillahunty; Herbert G. Burkard

[57] ABSTRACT

A heating element having a positive temperature coefficient conductive polymer with positive and negative electrodes formed on opposite faces thereof includes a high tensile strength coating layer on the electrodes. Buss bars are electrically connected to their respective electrode by stapling, with staples forming burrs in the buss bar which penetrate the coating layer and electrically connect with the corresponding electrode.

9 Claims, 3 Drawing Figures

HEATING ELEMENT HAVING DEFORMED BUSS BARS

BACKGROUND OF THE INVENTION

1. Field of the Invention

The present invention relates to heating elements including an improved means for electrically interconnecting a buss bar and an electrode.

2. Description of the Prior Art

Expandable and/or contractable heating elements including polymers which are made electrically conductive by dispersing therein suitable amounts of finely divided conductive fillers are well known in the art, and such heating elements are described in U.S. Pat. Nos. 4,177,446; 4,223,209; and 4,318,220; all of which are owned by the assignee of the present invention. The disclosures of each of these patents is hereby incorporated herein by reference.

Such heating elements are particularly useful as components of articles which comprise a heat-responsive sheet material which experiences dimensional changes upon being heated above a predetermined temperature. The heating element may be in direct contact with the sheet material, for example, secured thereto by an adhesive, or may be separated therefrom by an intermediate layer provided that there is adequate heat transfer between the heating element and the sheet material. The article is preferably flexible, at least at the temperature at which the sheet material becomes responsive.

The term "heat-responsive" is used herein to mean that when the sheet material is heated to a suitable temperature, it (a) undergoes a spontaneous change in at least one dimension in a plane thereof; and/or (b) undergoes some other change, e.g., it softens (including flows), which substantially reduces the external forces, (e.g. manual forces) required to change at least one dimension of the sheet material in the plane thereof. The sheet material preferably comprises an organic polymer, for example, a polymeric film which is heat-recoverable or can be rendered heat-recoverable, an adhesive (for example, a hot-melt or heat-activatable adhesive) or a mastic.

The heating element in such articles is placed adjacent the sheet material in such a way that the sheet material is capable of changing its dimensions in the required way when the article is heated. Such articles generally have one heater element and one sheet material, but may contain more than one element and/or more than one sheet material; for example, they may comprise an element sandwiched between two sheet materials or one sheet material sandwiched between two elements.

When the sheet material is a polymeric film which is heat-recoverable or can be rendered heat-recoverable, it preferably comprises a crystalline cross-linked polymer. Suitable polymers for heat-recoverable sheet materials are well-known in the art, see for example, U.S. Pat. No. 3,086,242, the disclosure of which is hereby incorporated by reference, and include polymers of one or more olefins and/or one or more ethylenically unsaturated monomers containing polar groups.

Heating elements of the type described are inherently weak mechanically, and accordingly, a need exists to strengthen the heating elements to accommodate stresses encountered when the sheet material undergoes dimensional changes. Although a coating having a mechanical strength could be applied to the heating element, and especially electrodes thereof, to provide the desired strength, a problem then exists in connecting buss bars with the electrodes electrically, since the coating acts as an insulator.

SUMMARY OF THE INVENTION

An object of the present invention is to provide a heating element having a relatively large mechanical strength and which includes buss bars which can easily be electrically connected to electrodes of the heating element. This and other objects of the invention are achieved by a heating element which includes a laminar member composed of a material which comprises an organic polymer and electrically conductive particles dispersed in the polymer in an amount sufficient to render the member electrically conductive, a pair of laminar electrodes which are (a) connected to opposite faces of the laminar member, (b) substantially parallel to the laminar member, and (c) adapted to be connected to an external source of power to cause current to pass through the laminar member, a coating layer applied to exposed surfaces of the electrodes, and means for electrically interconnecting the electrodes to an external source of power.

In a preferred embodiment, positive and negative buss bars are stapled to opposite surfaces of the coating member such that legs of the staples passing through the positive buss bar pass through the electrodes in such a manner that burrs of the positive buss bar caused by the stapled legs extend through the coating member and electrically interconnect with the positive electrode, and further such that legs of staples which pass through the negative buss bar pass through the electrodes such that burrs of the negative buss bar electrically connect with the negative electrode. Parts of the negative electrode pierced by the staple legs of the staples of the positive buss bar are electrically isolated from the negative buss bar to prevent short circuiting, and the same is true of parts of the positive electrode pierced by the staple legs of the negative buss bar.

DESCRIPTION OF THE PREFERRED EMBODIMENTS

Figure 1:
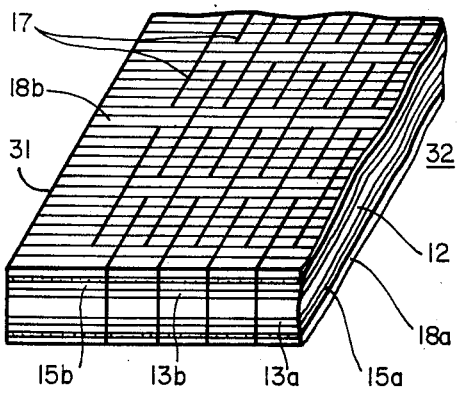
FIG 1 (PRIOR ART)
FIG. 1 is a prior art isometric view of a part of a heating element according to the present invention, prior to expansion.
Figure 2:
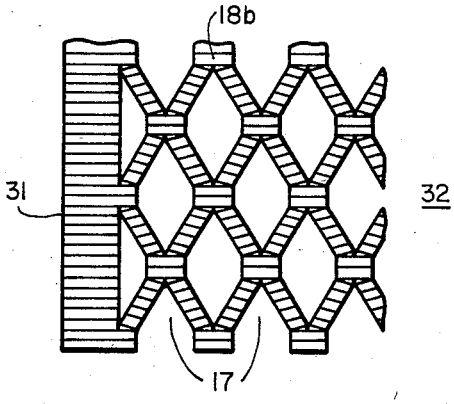
FIG 2 (PRIOR ART)
FIG. 2 is a prior art plan view of a part of the heating element of FIG. 1 after it has been expanded.

Referring now to the drawings, FIG. 1 is an isomeric view of a part of a heating element to which the present invention is concerned. The element comprises a layer 12 composed of a conductive polymer which exhibits PTC behavior (positive temperature coefficient behavior). Adherent to layer 12 are constant wattage layers 13*a* and 13*b* which are composed of a conductive polymer and preferably exhibit PTC behavior with a "switching temperature" higher than layer 12. Layers 13*a* and 13*b* are heat laminated metal foil layers 15*a* and 15*b* being secured thereto. In a preferred embodiment, layers 13*a* and 13*b* can be omitted if layer 12 is made to adhere to the electrodes 15*a* and 15*b*. There is a plurality of slits formed in parallel staggered rows 17. The slits will generally be somewhat longer than is shown in the drawings. The edge portions of the sheet parallel to the slits do not contain perforations. When these edge portions are separated, the slits form apertures which are diamond-shaped, as illustrated in FIG. 2. Buss bars are secured to the heating elements in a vicinity of these edge portions. Alternatively, the heating element can be formed to originally have diamond-shaped apertures, such as by stamping, thus eliminating the need for forming the slits 17.

To provide additional mechanical strength to the heating element, a coating member 18*b* is formed adjacent the electrode 15*b*, and can be secured thereto by any convenient means such as adhesive 27. The coating member can comprise a high tensile strength polyester such as, for example, Mylar.

If high mechanical strength coating members 18*a*, 18*b* are applied to the electrodes 15*a*, 15*b*, a problem exists in that it is difficult to electrically connect the positive and negative buss bars with the positive and negative electrodes, respectively, the buss bars being electrically connected with positive and negative terminals of a power source (not shown). Though it is possible to form the coating member 18*a*, 18*b* only on specified portions of the electrodes 15*a*, 15*b* and leave portions of these electrodes uncoated so that the respective positive and negative buss bars can easily be connected thereto by rivets, such a procedure of selectively coating the electrodes is unduly time-consuming and expensive.

In accordance with the present invention, the entire positive and negative electrodes 15*a*, 15*b* are coated with the coating members 18*a*, 18*b* and the buss bars 20*b a*, 20*b* are electrically connected to electrodes 15*a*, 15*b* by stapling the buss bar and electrode together using staples 26. It has been found that legs 28 of the staples 26 create burrs 22 in the buss bars 20*a*, 20*b* as the legs 28 penetrate the buss bars, which burrs extend down through the coating members 18*a*, 18*b* and any adhesive 27 adjacent thereto. The burrs 22 penetrate corresponding electrode (15*b* illustrated in FIG. 3) and electrically interconnect the buss bar 20*a*, 20*b* with its corresponding electrode. Accordingly, an easy, convenient, and inexpensive procedure can be utilized for electrically interconnecting the heating element buss bar with its corresponding electrode, while providing a high tensile strength coating member over the surface of the electrodes so that the heating element has adequate mechanical strength.

Preferably, the buss 20*a*, 20*b* are electrically connected to the electrodes 15*a*, 15*b* by a set of staples roughly equidistantly spaced along a length of the buss bar. In practice, it has been found that a relatively large current of the order of 2–3 amps can be conducted by each burr created by each staple leg 28.

Figure 3:
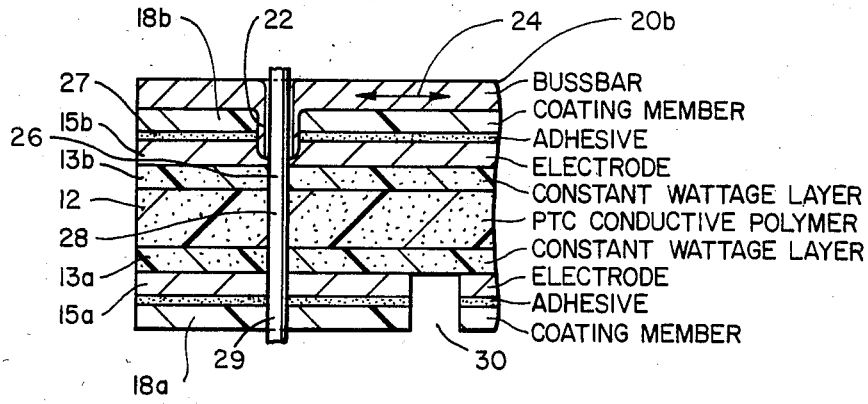
FIG. 3 is a sectional view of the heating element having a buss bar electrically connected to one of the heating element electrodes.

To prevent the staple leg 28, used for electrically inter-connecting the positive buss bar 20 with the positive electrode 15*b*, from penetrating the negative electrode 15*a* and thus shorting out the circuit, the negative electrode portion 15*a* through which the staple legs of the positive buss bar penetrate is electrically isolated from the negative buss bar by any suitable means, such as etching, as generally illustrated by reference numeral 30 in FIG. 3. In practice, it has been found that an etching width of 40 mils is sufficient to prevent any arcing from occurring between the negative electrode and the leg 29.

In a preferred embodiment, the positive and negative buss bars 20*a*, 20*b* are placed adjacent opposite sides of the heating element and displaced apart from one another along a width-wise direction of the heating element such that, for example, the positive electrode extends along one side edge 32 of the heating element while the negative buss bar extends along the other opposite side edge 31 of the heating element.

Though the invetion has been described with respect to certain preferred embodiments, it should be understood that the invention is not intended to be limited thereby.

We claim:

1. A heating element comprising:

a laminar member composed of a material which comprises an organic polymer and electrically conductive particles dispersed in the polymer in an amount sufficient to render the member electrically conductive;

a pair of laminar electrodes which are (a) connected to opposite faces of said laminar member, (b) substantially parallel to said laminar member; and (c) adapted to be connected to an external source of power to cause current to pass through said laminar member;

an insulating coating layer secured to exposed surfaces of said electrodes; and means for electrically interconnecting at least one electrode to said external source of power, said electrical interconnection means comprising at least one buss bar disposed adjacent said coating layer and means for deforming parts of said buss bar so that portions of said buss bar in a vicinity of said parts extend through said coating layer adjacent thereto into said at least one of said electrodes.

2. The heating element as claimed in claim 1, said electrodes comprising flexible electrodes.

3. The heating element as claimed in claim 2, said coating layer comprising a high tensile strength polyester.

4. The heating element as claimed in claim 3, said high tensile strength polyester comprising PET.

5. The heating element as claimed in claim 1, said deforming means comprising a plurality of staples having legs which extend through said buss bar, coating layer adjacent thereto, and said at least one of said electrodes.

6. The heating element as claimed in claim 1, said electrodes comprising a positive flexible electrode and a negative flexible electrode, said electrical interconnection means comprising a positive and a negative buss bar, said positive buss bar being disposed adjacent said coating layer opposite said positive electrode, said negative buss bar being disposed adjacent another coating layer disposed opposite said negative electrode, said electrical interconnection means comprising first and second sets of staples having legs, said first set of staples having legs extending through said positive buss bar and said positive electrode, said second set of staples having legs extending through said negative buss bar and said negative electrode, said positive and negative buss bars being displaced along a width-wise direction of said heating element.

7. The heating element as claimed in claim 6, said positive buss bar being disposed adjacent one side of said heating element and said negative buss bar being disposed adjacent an opposite side of said heating element.

8. The heating element as claimed in claim 1, said deforming means comprising wire stitching.

9. The heating element as claimed in claim 1, said deforming means comprising pre-formed holes in said buss bars formed so as to create burrs extending therefrom.

* * * * *